United States Patent [19]

Drebes

[11] 3,951,750

[45] Apr. 20, 1976

[54] APPARATUS FOR CHARGING PREHEATED COAL INTO COKE OVENS

[75] Inventor: Friedrich Wilhelm Drebes, Bochum, Germany

[73] Assignee: Dr. C. Otto & Comp. G.m.b.H., Bochum, Germany

[22] Filed: Sept. 3, 1974

[21] Appl. No.: 502,657

[30] Foreign Application Priority Data

Sept. 7, 1973 Germany ..... 2345154

[52] U.S. Cl. ..... 202/262; 202/251; 201/40; 214/18 R; 214/35 R; 198/220 A; 198/220 BA; 198/66

[51] Int. Cl.[2] ..... C10B 31/02

[58] Field of Search ..... 202/262; 201/40; 198/220 A, 220 BA, 66; 214/18 R, 35 R

[56] References Cited

UNITED STATES PATENTS

| | | | |
|---|---|---|---|
| 2,674,381 | 4/1954 | Cady | 198/220 BA X |
| 2,676,915 | 4/1954 | Dupre | 201/40 X |
| 3,753,867 | 8/1973 | Wiemer | 202/262 |

*Primary Examiner*—James H. Tayman, Jr.
*Attorney, Agent, or Firm*—Brown, Murray, Flick & Peckham

[57] ABSTRACT

Charging apparatus is provided for charging preheated coal into a battery of coke oven chambers from a bunker above the battery which has sufficient capacity to contain enough coal to charge at least one oven chamber. Each oven chamber has a plurality of charging holes in the roof and the charging holes of the several chambers are arranged in rows extending longitudinally of the battery. A vibratory conveyor is associated with each row of charging holes for selectively delivering coal to the holes, and coal is supplied from the bunker to each conveyor through a measuring chamber which holds a predetermined amount of coal and delivers exactly the right amount to the conveyor for charging one oven chamber.

1 Claim, 2 Drawing Figures

APPARATUS FOR CHARGING PREHEATED COAL INTO COKE OVENS

BACKGROUND OF THE INVENTION

The present invention relates to apparatus for charging preheated coal into coke oven chambers arranged in a battery from a coal bunker disposed above the battery and large enough to contain sufficient coal to charge at least one oven chamber.

Coke is produced from coal in coke ovens which usually consist of a number of oven chambers arranged in a battery or batteries. In many cases, it is desirable to preheat the coal before charging it into the oven chambers to reduce the length of the coking time and thus increase the productivity of the coke oven. This results in a substantial cost reduction in many cases where the saving in costs of the coking plant outweighs the operating costs and capital cost of the necessary coal preheating plant. There are also certain types or grades of coal whose coking properties are improved if they are preheated before being charged into the coke oven. This frequently makes it possible to use non-coking grades of coal. Thus, the use of preheated coal is frequently desirable.

There are, however, certain problems in charging preheated coal into a coke oven. Most coal preheating processes are essentially continuous processes which supply a continuous stream of preheated coal. The normal horizontal coke ovens, however, operate intermittently in a batch-type process and must be charged with coal at more or less regular time intervals. With a continuous supply of preheated coal, therefore, a storage bunker must be provided for the coal which has sufficient capacity to contain the necessary amount of coal for charging at least one of the coke oven chambers, and preferably several chambers. The coal must then be conveyed in batches from the bunker to the individual oven chambers in the correct predetermined quantities for charging the chambers. This must be done in a manner to protect the preheated coal from the air and to minimize the time required for charging. It is especially important to keep the charging time as short as possible since charging preheated coal into the heated coke oven intensifies the evolution of charging gases, and the excess pressure in the oven chamber, which always accompany the charging of coal.

SUMMARY OF THE INVENTION

The present invention provides an apparatus for charging preheated coal to a battery of coke oven chambers in which the coal is delivered from a bunker above the battery in precisely determined amounts to the oven chambers and in a manner which meets the foregoing requirements.

More specifically, in accordance with the invention, the oven chambers of a battery of coke ovens are each provided with a plurality of charging holes, and the charging holes of the several chambers are arranged in rows extending longitudinally of the coke oven battery. Preheated coal is supplied from a bunker of sufficient size disposed above the coke oven battery to vibratory conveyors, a conveyor being associated with each row of charging holes. The conveyors are preferably tubular, or otherwise closed to protect the heated coal from the air and each conveyor tube has an outlet associated with each charging hole in its row of holes with closure means for the outlets so that the coal can be selectively discharged from the conveyor to the proper charging hole. Coal is transmitted from the bunker to each conveyor through a measuring vessel which contains an accurately measured quantity of coal and releases this predetermined amount of coal to the conveyor for charging into an oven chamber. The vibratory conveyors are mounted on springs on the roof of the oven battery to prevent transmission of vibration to the oven structure itself, and connecting members are provided between the measuring vessels and the respective conveyors, and between each conveyor and the respective charging holes, to direct the coal and protect it from the air and which are sufficiently resilient to isolate the vibration of the conveyor.

BRIEF DESCRIPTION OF THE DRAWINGS

The invention will be more fully understood from the following detailed description, taken in connection with the accompanying drawing, in which.

DESCRIPTION OF THE PREFERRED EMBODIMENT

Figure 2:
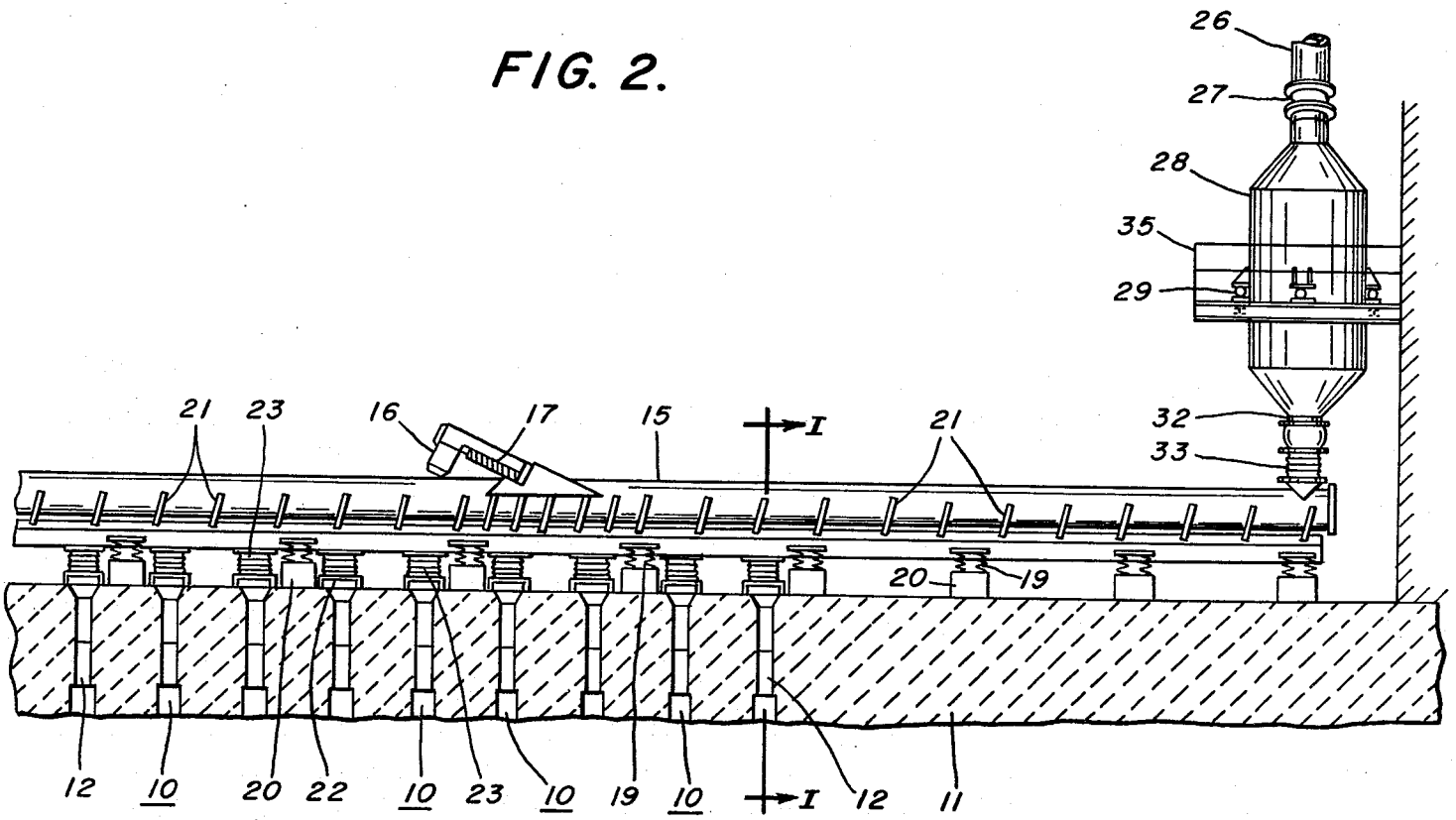
FIG. 2 is a view of the charging apparatus partly in side elevation and partly in longitudinal section substantially on the line II—II of FIG. 1.

Referring now to the drawing, there is shown a coke oven comprising a plurality of oven chambers 10 disposed one behind another to form a battery of oven chambers as shown in FIG. 2. Each oven chamber 10 has a plurality of charging holes 12 extending through the roof 11 for charging coal into the chamber, and exhaust shafts 13 are provided at each end of the chamber for removing charging gases, and gases evolved during distillation of the coal, which are discharged through pipes 14 for suitable disposition. A plurality of charging holes 12 is provided for each chamber 10 to insure a good distribution of the coal throughout the chamber. In the embodiment shown in the drawing, each oven chamber 10 has three charging holes 12, and the holes 12 of the several chambers 10 are arranged in rows extending longitudinally of the battery of oven chambers as shown particularly in FIG. 2.

Figure 1:
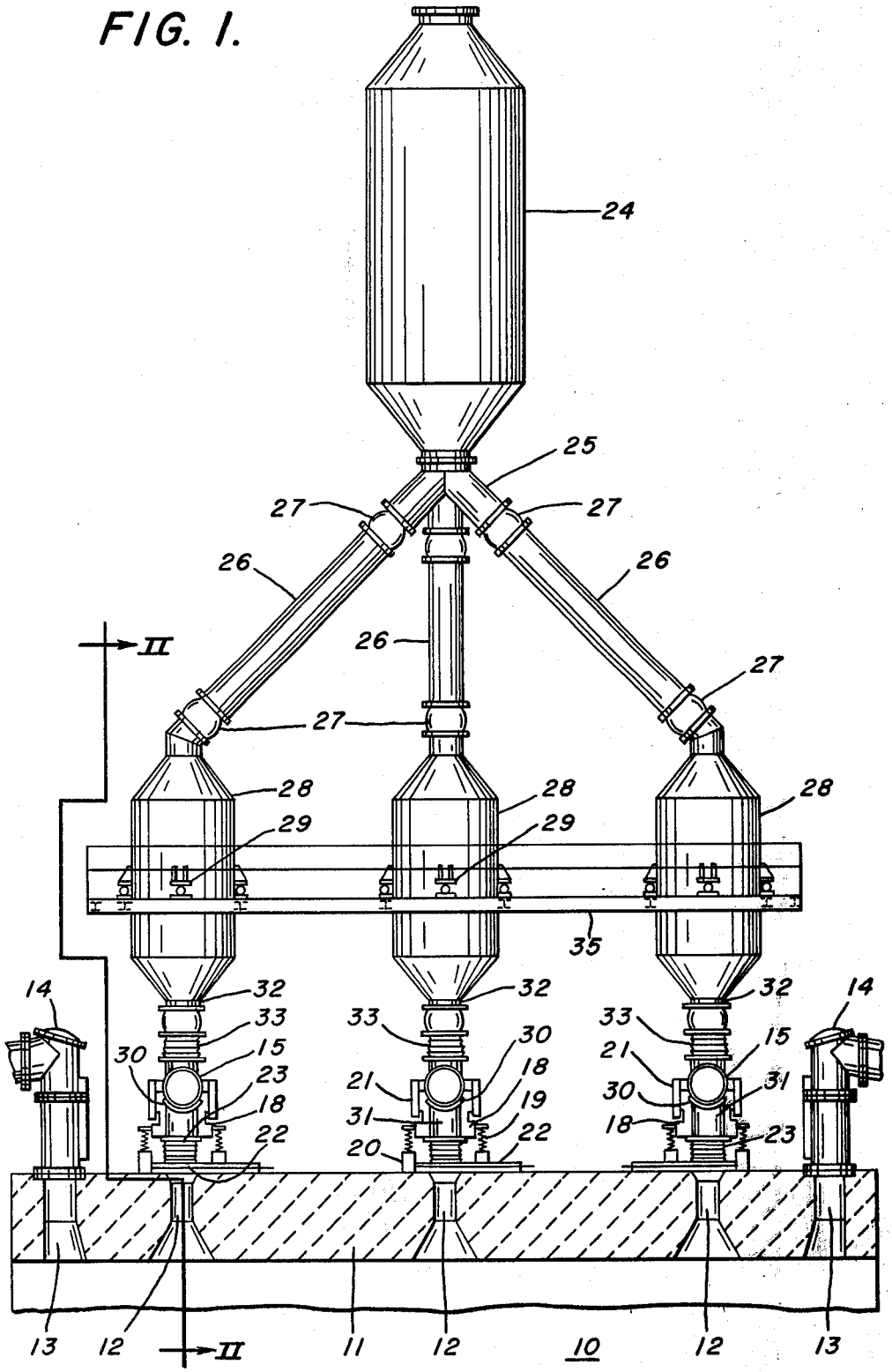
FIG. 1 is a view in elevation, and partly in transverse section substantially on the line I—I of FIG. 2, showing a charging apparatus embodying the invention positioned on the roof of a battery of coke oven chambers.

Coal is supplied to the charging holes 12 of the chambers 10 by a conveyor 15 associated with each row of charging holes. Thus, as can be seen in FIG. 1, three conveyors 15 are provided associated respectively with the three rows of holes 12 and extending longitudinally of the coke oven battery across all of the oven chambers 10. The conveyors 15 are preferably of the vibratory type, and in order to protect the heated coal from the air, each conveyor 15 comprises a tubular member which completely encloses the coal. The tubular member is mounted on a frame 18 by means of leaf springs 21, and the frame 18 is supported on vertical springs 19 carried on brackets 20 mounted on the roof 11 of the oven chambers. The vibrating conveyor is thus isolated from the oven structure by the springs so that no damaging vibration is transmitted to the oven itself. A vibrator 16 of any suitable type is provided for exciting the vibratory movement of the conveyor tube 15, and is preferably connected to the springs 21 through correspondingly dimensioned springs 17 to insure uniformity of vibration and uniform speed of conveying the coal.

Preheated coal is supplied from a bunker 24 mounted in any suitable manner above one end of the coke oven battery. Preheated coal may be supplied continuously to the bunker 24 which is of suitable size to contain enough coal for charging at least one of the oven chambers 10 and preferably several chambers. Coal is supplied by gravity feed from the bunker 24 through a distributing member 25 which in the illustrated embodiment has three legs for distribution of the coal to the three conveyors. The distributing member 25 transmits the coal from the bunker 24 to downwardly-extending feed pipes 26 which have closure members 27 at both ends thereof. The closures 27 may be operable manually or in any desired manner to open and close them to control the flow of coal from the bunker 24.

The feed pipes 26 deliver the coal to respective measuring vessels 28. The measuring vessels 28 are designed to contain a predetermined quantity of coal equal to the amount required for each charging hole 12 to fully charge an oven chamber 10. For this purpose, the vessels 28 are made of the proper size and are mounted on a supporting framework 35 by means of load cells 29, so that the amount of coal in each vessel can be accurately determined and the closures 27 closed when the correct amount of coal has been delivered to each measuring vessel 28. Each vessel 28 has a closure member 32 at the bottom thereof which may be actuated in any desired manner to release the coal in the vessel to pass to the corresponding conveyor 15.

Each measuring vessel 28 is connected to transmit the coal contained in it to the corresponding conveyor 15. For this purpose, each vessel 28 is connected to its conveyor tube 15 by a connecting member 33 which is of a type to damp any vibration transmitted to it by the vibratory conveyor. Thus, as shown in the drawing, the members 33 may be tubular bellows-type devices which enclose the coal so that it is not exposed to the air and which have sufficient resilience to absorb the vibration to which they are subjected. The vessels 28 are thus effectively isolated from the vibration of the conveyors 15 but are connected to them in a manner which protects the preheated coal from the air.

Each conveyor 15 has a plurality of discharge outlets 31 corresponding in position to the charging holes 12 with which the conveyor is associated. Each outlet 31 is closed by a movable closure member 30 which can be actuated in any desired manner, and the outlets 31 may each consist, as shown, of a vertical section of tubing through which the coal can pass to a charging hole 12. Connecting members 23 are provided between each of the outlets 31 and the entrance of the charging hole 12. The connecting members 23 may be bellows-type devices similar to the members 33 described above and are provided for the same purpose, that is, to isolate the vibration of the conveyor 15 from the oven structure so as to avoid any possibility of damage due to the vibration while protecting the coal from the air. A closure member 22 is also provided for each charging hole 12 which is opened during charging but normally remains closed to protect the conveyor tube 15 and outlet 31 against heat radiated from the oven.

The operation of this charging apparatus will be apparent. The bunker 24 is kept more or less completely filled by continuous flow of preheated coal. When it is desired to charge one of the oven chambers 10, coal is allowed to flow by gravity through the pipes 26 into the measuring vessels 28. Each measuring vessel 28 holds the correct amount of coal to completely charge the corresponding section of an oven chamber 10, as determined by the number of charging holes, three being shown in the illustrated embodiment. When each vessel 28 contains its predetermined amount of coal as determined by the load cells 29, the closures 27 are closed to shut off the flow of coal from the bunker, and the closures 32 of the measuring vessels 28 are opened to allow the coal in each vessel to flow by gravity to the corresponding conveyor 15. The conveyors 15 are of the vibratory type driven by the vibrator 16 with a strong enough excitation in the longitudinal direction of the conveyor, and at the proper frequency, to obtain a relatively high and uniform velocity of flow of the coal through the conveyor. The time required for charging an oven chamber is thus kept very short. As the coal flows into the conveyors 15 from the vessels 28, the closures 22 and 30 for the charging holes 12 of the chamber 10 which is to be charged are opened so that the coal flows from the conveyors 15 through the charging holes into the chamber 10, and as soon as charging is completed, the closures 22 and 30 are reclosed. The apparatus is then ready to repeat the process to charge another chamber 10.

It should now be apparent that an improved charging apparatus has been provided for charging preheated coal into a battery of coke oven chambers. This is accomplished by the use of vibratory conveyors in such a manner that the charging time, that is, the time in which the charging holes must be open, is kept to a minimum while the coal is protected from the air. No special propellants such as steam or inert gases are required because of the use of the vibratory conveyors, and a relatively simple apparatus is thus made possible as the coal itself is fed by gravity from the bunker to the conveyors. At the same time, the coal is precisely measured so that exactly the right amount is supplied to each charging hole. The spring mounting of the conveyors effectively isolates the vibration so that neither the oven structure nor the measuring vessels are adversely affected.

I claim as my invention:

1. Charging apparatus for charging preheated coal into the oven chambers of a battery of coke ovens from a bunker disposed above the battery, each oven chamber having a plurality of charging holes in the roof thereof and the charging holes of the several oven chambers being arranged in rows extending longitudinally of the battery, said charging apparatus comprising conveyor means associated with each row of charging holes, each of said conveyor means being a vibratory conveyor having a tubular conveyor member through which the coal passes, each of said tubular conveyor members being spring mounted on a frame and each frame being supported on springs on the roofs of the oven chambers, each conveyor means having a discharge outlet for each charging hole, closure means for each outlet, resilient, vibration-absorbing tubular members between the outlets of each conveyor and each charging hole, a measuring vessel for each conveyor adapted to receive a predetermined amount of coal and to transmit the coal to the conveyor, resilient, vibration-absorbing tubular members joining each measuring vessel to its associated conveyor, and means including downwardly-extending pipes for connecting said bunker to each of said measuring vessels.

* * * * *